United States Patent [19]

Trombley

[11] Patent Number: 4,944,319

[45] Date of Patent: Jul. 31, 1990

[54] HAIR STYLING DEVICE

[76] Inventor: Ken Trombley, 5613 No. 52nd St., Tacoma, Wash. 98407

[21] Appl. No.: 282,306

[22] Filed: Dec. 9, 1988

[51] Int. Cl.[5] ..... A45D 2/36; A45D 2/12

[52] U.S. Cl. ..... 132/238; 132/229

[58] Field of Search ..... 132/237, 238, 229

[56] References Cited

U.S. PATENT DOCUMENTS

| | | | |
|---|---|---|---|
| 576,244 | 2/1897 | Williams | 132/238 |
| 752,051 | 2/1904 | Dyer | 132/238 |
| 1,589,110 | 6/1926 | Cotter | 132/238 |
| 2,608,195 | 8/1952 | Ledbedter | 132/238 |
| 2,764,985 | 10/1956 | Papish | 132/238 |
| 2,797,692 | 7/1957 | Lenzi | 132/238 |
| 3,413,984 | 12/1968 | Tracy et al. | 132/238 |
| 3,463,169 | 8/1969 | Zaidan | 132/238 |
| 3,863,652 | 2/1975 | Scivoletto | 132/118 |
| 3,890,984 | 6/1975 | Lesetar | 132/238 |
| 3,894,547 | 7/1975 | Scivoletto | 132/119.1 |
| 4,130,122 | 12/1978 | Kennedy | 132/238 |
| 4,192,326 | 3/1980 | Klinge | 132/238 |
| 4,222,398 | 9/1980 | Fromman | 132/238 |
| 4,233,999 | 11/1980 | Thomas | 132/238 |
| 4,409,998 | 10/1983 | Bauer | 132/227 |
| 4,442,849 | 4/1984 | Kawabe | 132/232 |
| 4,664,132 | 5/1987 | Schillig | 132/271 |

*Primary Examiner*—Paul J. Hirsch
*Attorney, Agent, or Firm*—Jerry T. Kearns

[57] ABSTRACT

A hair styling brush with an internal heating element extends from a first end of a housing. A disk secured to the brush is rotationally mounted in an undercut groove adjacent the first housing end. A pinion gear secured by a threaded stud to an interior face of the disk engages a gear rack formed on a push button received for sliding movement within a transversely extending well within the housing. A first ring nut is threadedly engaged with the threaded stud. A coil spring has a first end loop connected to the first ring nut and a second end loop connected to a second ring nut secured adjacent a second opposite end of the housing. The second ring nut has a central longitudinal bore aligned with an aperture formed through the second housing end. A power cord extends sequentially through the second housing end, the second ring nut, the coil spring, the first ring nut, the pinion gear, the threaded stud, the disk and connects with the internal brush heating element. In an alternative construction, the coil spring may be replaced by a transversely extending compression coil spring which has a first end in abutment with a lower end of the push button and a second end in abutment with an interior housing surface.

2 Claims, 5 Drawing Sheets

HAIR STYLING DEVICE

BACKGROUND OF THE INVENTION

1. Field of the Invention

The present invention relates to hair styling devices, and more particularly pertains to a new and improved hair curling brush having an internal heating element. A mechanism enables one handed rotation of the brush to curl an individual's hair.

2. Description of the Prior Art

Various types of hair styling devices are known in the prior art. A typical example of such a hair styling device is to be found in U.S. Pat. No. 3,863,652, which issued to J. Scivoletto on Feb. 4, 1975. This patent discloses a heated hair curling brush which is provided with a motor driven brush. U.S. Pat. No. 3,894,547, which issued to J. Scivoletto on July 15, 1975, discloses a similarly constructed heated hair styling brush with a motor driven rotational brush. U.S. Pat. No. 4,409,998, which issued to R. Bauer on Oct. 18, 1983, discloses a hair styling device which utilizes a rotational brush in conjunction with a heated air blower. The device is provided with a rotationally mounted motor driven brush. U.S. Pat. No. 4,664,132, which issued to K. Schillig on May 12, 1987, discloses a motorized hair styling brush with a reversible direct current motor. Torque is transferred from a drive shaft through the rotating brush through a thrust bearing that enables limitation of the maximum torque deliverable to the hair brush. An adjustment mechanism is provided for regulating the maximum applied torque. U.S. Pat. No. 4,442,849, which issued to S. Kawabe on Apr. 17, 1984 discloses curling iron having a clamping member rotatably mounted on the iron handle. Alternative electrical and mechanical mechanisms are disclosed for rotating the clamping member to facilitate a curling or waving operation. The device may include a rack and pinion mechanism actuated by an external pivotal lever.

While the above mentioned devices are suited for their intended usage, none of these devices disclose a hair styling brush adapted to be manually rotated by a transversely reciprocating push button. Additionally, none of the above devices disclose the use of a longitudinally extending torsional coil spring to bias a rotational brush for return rotation. An additional feature of the present invention, not disclosed by the aforesaid prior art devices is the provision of aligned apertures through internal components of a rotational mechanism for permitting passage of a power cord to an internal brush heating element. Inasmuch as the art is relatively crowded with respect to these various types of hair styling devices, it can be appreciated that there is a continuing need for and interest in improvements to such hair styling devices, and in this respect, the present invention addresses this need and interest.

SUMMARY OF THE INVENTION

In view of the foregoing disadvantages inherent in the known types of hair styling devices now present in the prior art, the present invention provides an improved hair styling device. As such, the general purpose of the present invention, which will be described subsequently in greater detail, is to provide a new and improved hair styling device which has all the advantages of the prior art hair styling devices and none of the disadvantages.

To attain this, representative embodiments of the concepts of the present invention are illustrated in the drawings and make use of a hair styling brush with an internal heating element which extends from a first end of an elongated housing. A cylindrical disk secured to the brush is rotationally mounted in a circular undercut groove adjacent a circular opening in the first housing end. A pinion gear is secured by a threaded stud to an interior face of the disk and engages a gear rack formed on a push button received for reciprocal sliding movement within a transversely extending well formed within the housing. A first ring nut has a central longitudinal bore which is threadedly engaged with the threaded stud. An elongated coiled spring received within the housing has a first end loop connected to the first ring nut and a second end loop connected to a second ring nut secured adjacent a second opposite end of the housing. The second ring nut has a central longitudinal bore aligned with an aperture formed through the second housing end. A power cord extends sequentially through the second housing end, the second ring nut, the coil spring, the first ring nut, the pinion gear, the threaded stud, the rotationally mounted disk and connects with the internal brush heating element. In use, the brush may be rotated in a first direction by depressing the push button and engaged with the hair of an individual. By then releasing the button, the brush is caused to rotate in an opposite direction to wind the hair of the individual around the brush. After a suitable interval, the push button is then depressed to remove the brush from the individual's hair. In an alternative construction, the longitudinally extending torsional coil spring may be replaced by a transversely extending compression coil spring which has a first end in abutment with a lower end of the push button and a second end in abutment with an interior housing surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair styling device which has all the advantages of the prior art hair styling devices and none of the disadvantages.

It is another object of the present invention to provide a new and improved hair styling device which may be easily and efficiently manufactured and marketed.

It is a further object of the present invention to provide a new and improved hair styling device which is of a durable and reliable construction.

An even further object of the present invention is to provide a new and improved hair styling device which is susceptible of a low cost of manufacture with regard to both materials and labor, and which accordingly is then susceptible of low prices of sale to the consuming public, thereby making such hair styling devices economically available to the buying public.

Still yet another object of the present invention is to provide a new and improved hair styling device which provides in the apparatuses and methods of the prior art some of the advantages thereof, while simultaneously overcoming some of the disadvantages normally associated therewith.

Still another object of the present invention is to provide a new and improved hair styling device which utilizes a rack and pinion mechanism to rotate a hair styling brush in opposite directions to curl an individual's hair.

Yet another object of the present invention is to provide a new and improved hair styling device which utilizes a rack and pinion mechanism in conjunction with a torsional coil spring to provide a spring rotational return of the hair styling brush.

Even still another object of the present invention is to provide a new and improved hair styling device which utilizes internal components provided with aligned longitudinal bores to allow passage of a power cord to an internal brush heating element.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A provides a partial longitudinal cross sectional view illustrating an alternative brush rotational return spring arrangement.

FIG. 4A is a transverse cross sectional view illustrating an alternative brush rotational return spring arrangement.

DESCRIPTION OF THE PREFERRED EMBODIMENT

Figure 1:
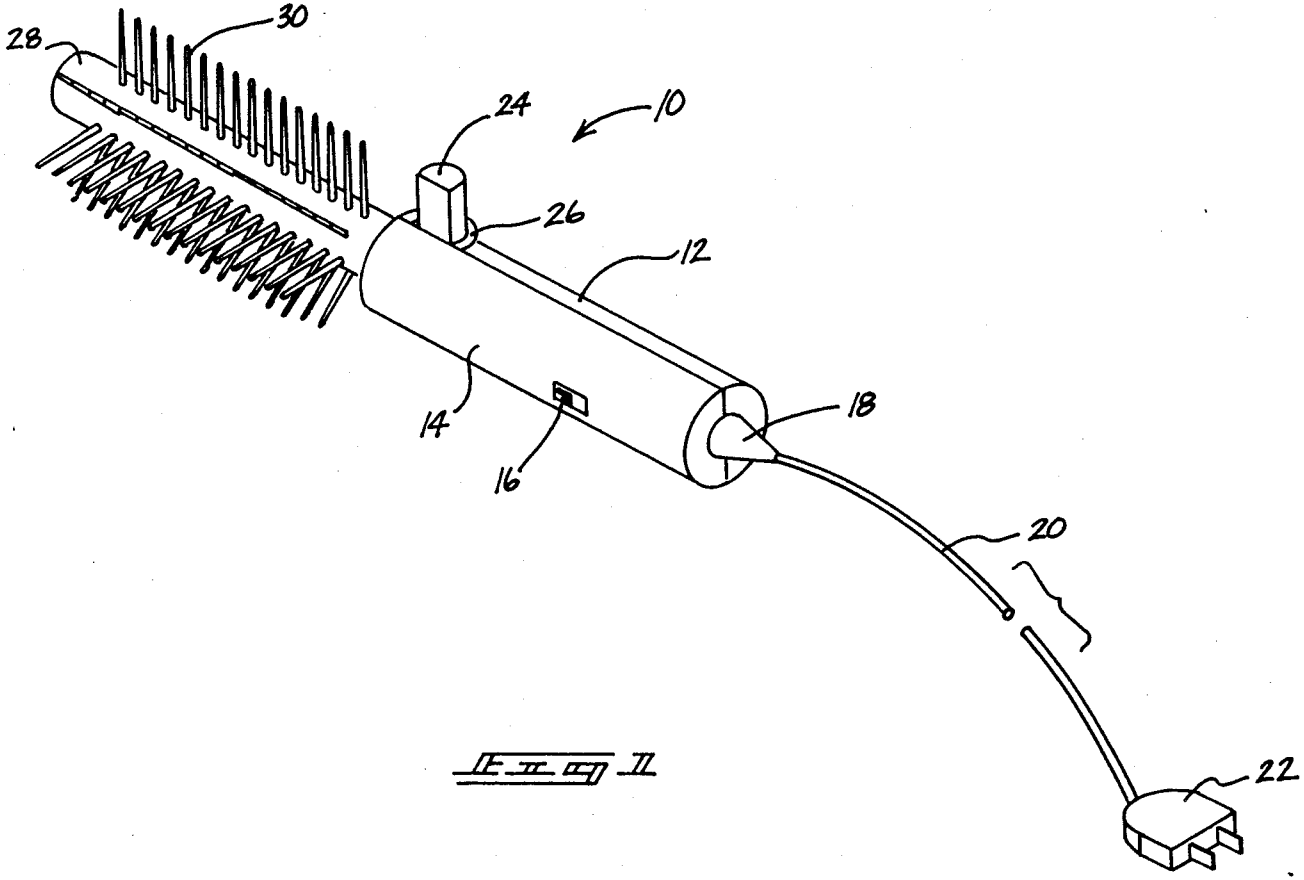
FIG. 1 is a perspective view of the hair styling device according to the present invention.

With reference now to the drawings, and in particular to FIG. 1 thereof, a new and improved hair styling device embodying the principles and concepts of the present invention and generally designated by the reference numeral 10 will be described.

More specifically, it will be noted that the first embodiment 10 of the invention includes a housing formed by aligned semi-cylindrical housing portions 12 and 14. A conventional switch 16 is provided on the housing half shell 14 for regulating operation of an internal brush heating device within a rotationally mounted brush 28. The brush 28 is provided in conventional fashion with circumferentially spaced rows of hair engaging tines or bristles 30. A power cord 20 has a conventional plug 22 for engagement with a conventional AC electrical socket. The power cord 20 extends through a grommet 18 through the interior of the housing and to the internal heating element within the brush 28. A transversely extending push button 24 is received for reciprocal sliding movement within a well 26 formed within the housing half shell 12. The push button 24 causes the brush 28 to be rotated in a first circular direction by a mechanism to be subsequently described. Upon release of the push button 24, the brush 28 is biased for circular return rotation by an internal mechanism to be described subsequently.

Figure 2:
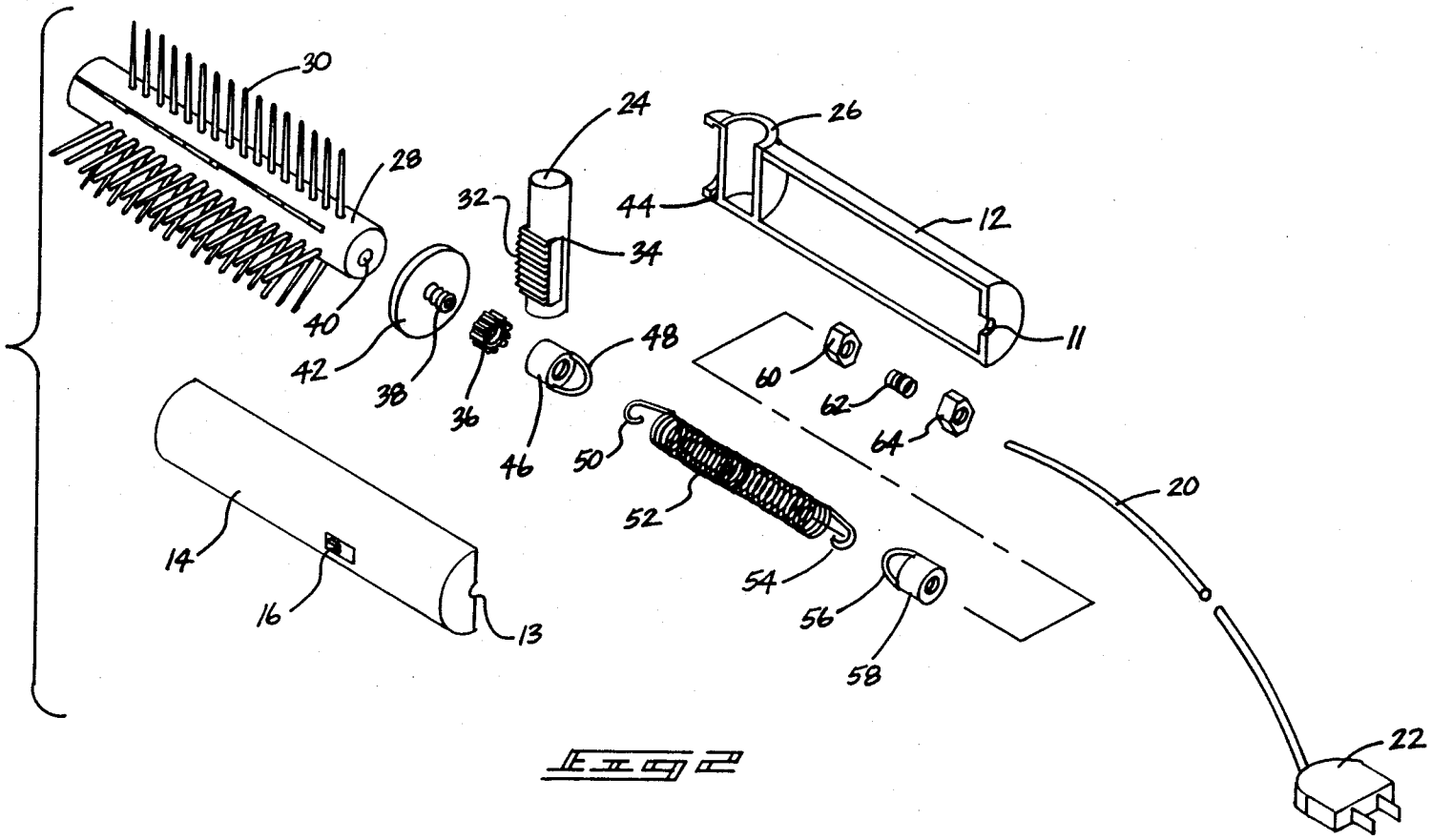
FIG. 2 is an exploded perspective view of the hair styling device of the present invention.

FIG. 2 provides an exploded perspective view of the components of the hair styling device of the present invention. A circular undercut groove 44 is formed adjacent a first end of the housing upon assembly of the housing shells 12 and 14. A circular disk 42 is received for rotation within the circular undercut groove 44 and covers a circular opening formed adjacent the first housing end. A threaded stud 38 is secured centrally through the disk 42 and has a central longitudinal bore. A pinion 36 is secured on the stud 38, on an interior face of the disk 42. The pinion 36 has a central longitudinal aperture in registry with the central bore of the stud. A first ring nut 46 has a central threaded longitudinal bore threadedly secured to the stud 38. A loop 48 on the ring nut 46 is connected to a first end loop 50 of a longitudinally extending torsional coil spring 52. A second end loop 54 of the coil spring 52 is secured to a loop 56 of a second ring nut 58. The second ring nut 58 is secured to a second end of the housing in alignment with an aperture 11 formed through the second housing end. This may be achieved by utilizing a second threaded stud 62 and nuts 60 and 64. The central bores of the various components allow passage of the power cord 20 sequentially through the aperture 11, the stud 62, ring nut 58, coil spring 52, ring nut 46, pinion 36, stud 38, disk 42 and through an aperture 40 in the brush 28 for connection with an internal heating element. A gear rack 32 is formed on the push button 24 and in an assembled condition, is in engagement with the pinion 36. The push button 24 is received for transverse reciprocal sliding movement within the well 26 formed on the housing 12. Upon depressing the push button 24, the gear rack 32 engages the pinion 36 causing rotation of the disk 42 and attached brush 28 in a clockwise direction. This also causes a clockwise windup of the torsional coil spring 52. Upon release of the push button 24, the torsional spring 52 causes reverse rotation of the pinion 36, disk 42 and brush 28 in a counter clockwise direction. This also moves the push button 24 back to an extended position. The push button 24 is retained within the well 26 by a lip 34 which engages the edges of the housing shell 14 in an assembled condition. In use, the push button 24 is depressed, causing the brush 28 to rotate in a clockwise direction. The tines or bristles 30 of the brush 28 are then placed into engagement with the hair of the individual, and the push button 24 is then released. This causes rotation of the brush 28 which winds the hair of the individual about the brush 28. The conventional operation of the internal electrical heating element then causes a setting of the hair. After passage of a selected time interval, the push button 24 is again depressed to release the hair of the individual from engagement with the brush tines 30.

Figure 3:
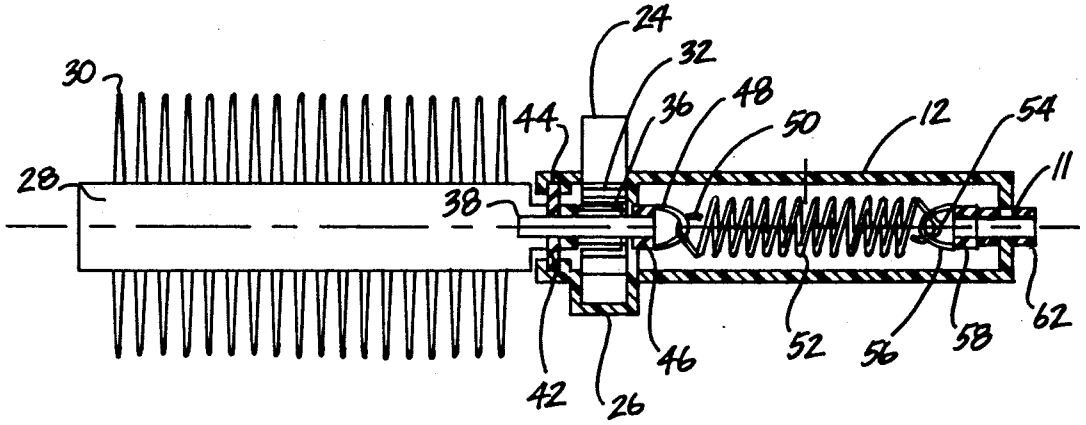
FIG. 3 is a longitudinal partial cross sectional view illustrating the construction of the hair styling device of the present invention.

FIG. 3 provides a partial longitudinal cross sectional view which illustrates the various components in an assembled condition. Several of the elements have been omitted for purposes of clarity. The rotational mounting of the disk 42 within the circular undercut groove 44 may now be readily understood.

Figure 4:
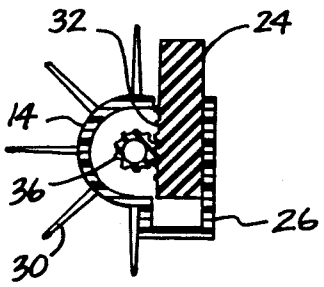
FIG. 4 is a transverse cross sectional view illustrating the rack and pinion hair brush rotating mechanism of the hair styling device of the present invention.
Figure 3:
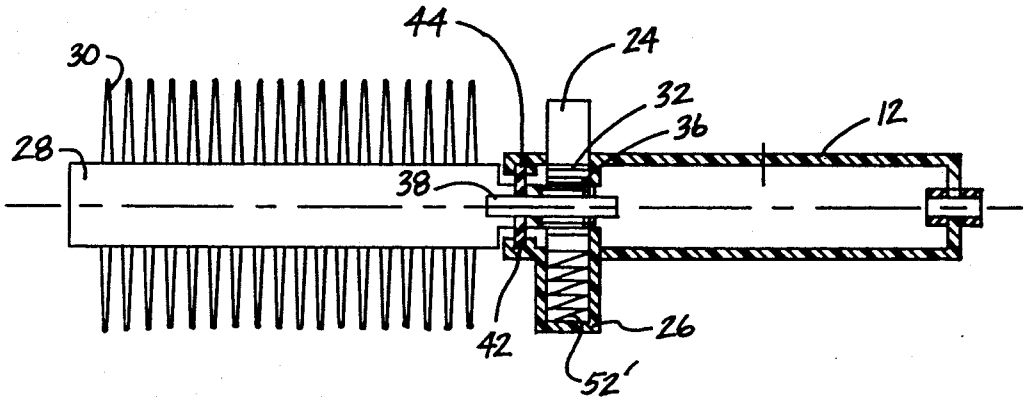
Figure 4:
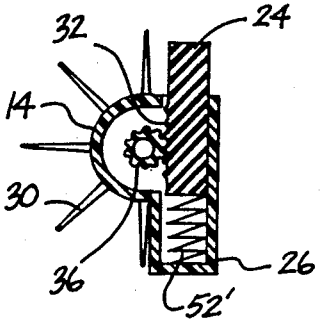

FIG. 4 provides a transverse cross sectional view which illustrates the engagement of the rack 32 of the push button 24 with the pinion 36.

With reference now to FIGS. 3A and 4A, an alternative push button return spring arrangement will now be described. In place of the longitudinally extending torsional coil spring 52, a compression coil spring 52' may be situated within the well 26 with a first end in engagement with a bottom of the push button 24 and a second end in engagement with an interior surface of the housing at the bottom of the well 26. This causes the push button 24 to be biased upwardly to an extended position. This construction allows elimination of the ring nuts 46 and 58, and also frees a substantial portion of the space within the interior of the housing for the reception of various electrical control components for the internal heating element within the brush 28.

Figure 5:
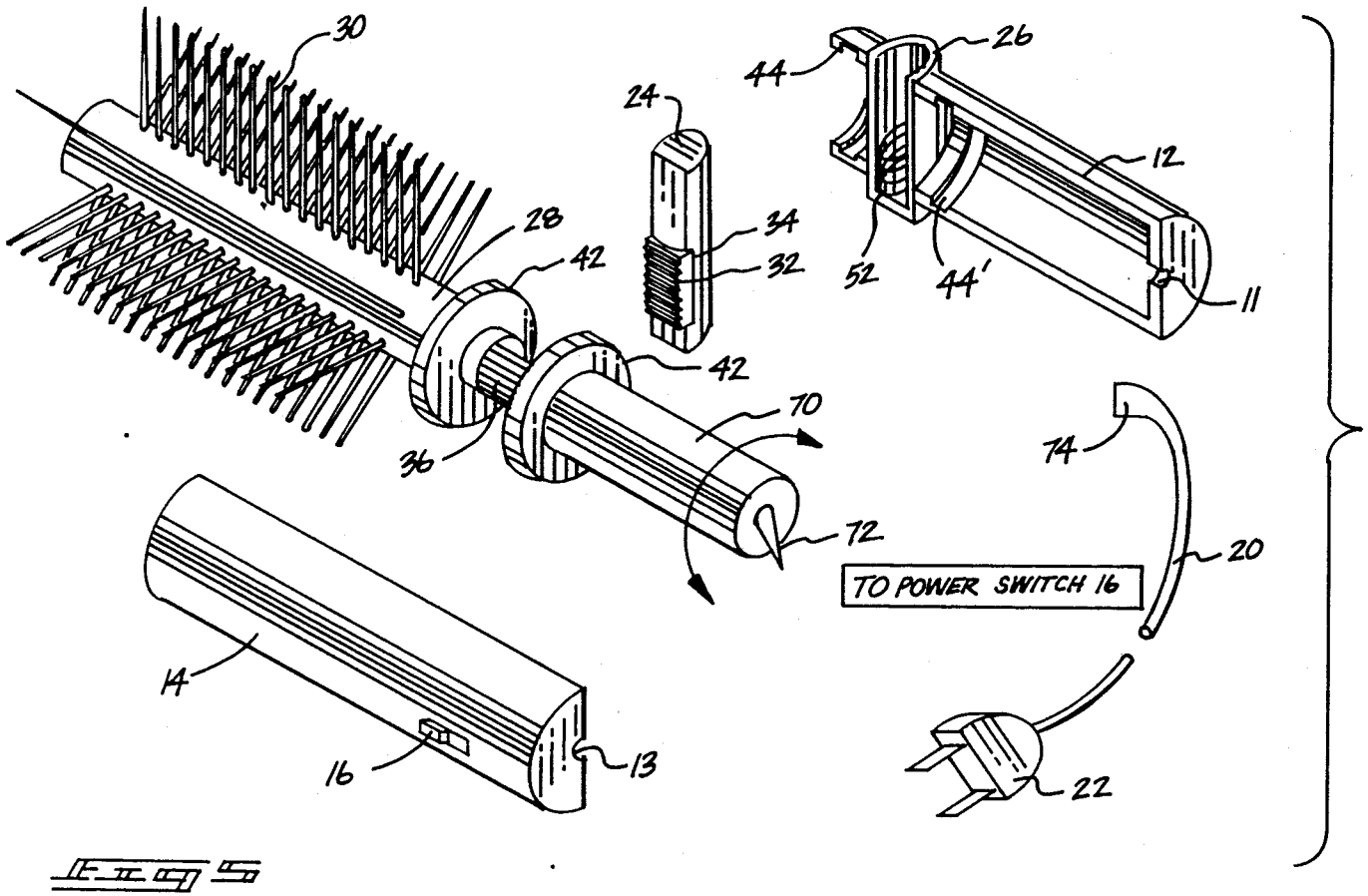
FIG. 5 is an exploded perspective view illustrating a slightly modified form of the invention.

FIG. 5 illustrates an exploded perspective view of a slightly modified form of the invention. The pinion gear or gear segment 36 is disposed between a pair of circular disks 42 and 42', which are received for rotation in undercut grooves 44 and 44'. A hollow tubular shaft 70 forms a conduit for electrical wiring to the heating element in the interior of the brush body 28. A rotary electrical connection, such as a conventional slip ring connector, connects the lead 72 with stationary wires in the conduit 70. The lead 72 is connected to the lead 74 of the power cord 74. This prevents twisting of the wires during rotation of the brush 28, which could eventually lead to failure through metal fatigue.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair styling device, comprising:

an elongated housing having first and second opposite ends;

a circular opening adjacent said first end of said housing;

a circular undercut groove in said housing adjacent said circular opening;

a circular disk covering said circular opening and rotationally mounted in said groove;

an externally threaded stud having a central bore and extending centrally through said disk;

an elongated brush secured to an outer side of said disk, by said stud, said brush having an internal electrical heating element;

a pinion gear coaxially secured to an inner side of said disk by said stud, said pinion gear having a central longitudinal aperture in registry with said central bore of said stud;

a first ring nut having a central threaded longitudinal bore threadably secured to said stud;

an elongated coil spring extending longitudinally within said housing and having a first end loop secured to said first ring nut;

a second ring nut fixed adjacent said second housing end;

said second ring nut having a central longitudinal bore aligned with an aperture formed through said second housing end;

a transversely extending well formed adjacent said first housing end;

a push button received for transverse reciprocal sliding movement in said well;

a gear rack on said push button engaging said pinion gear; and a power cord extending sequentially through said aperture in said second housing end, said second ring nut, said coil spring, said first ring nut, said pinion gear, said pinion stud, said disk and connected with said internal heating element.

2. A hair styling device, comprising:

an elongated housing having first and second opposite ends;

a rotatably mounted brush extending from a first end of said housing;

an electrical heating element within said brush;

an elongated hollow tubular member having a first end connected to said brush and a second end extending interiorly of said housing;

electrical wires extending through said tubular member to said heating element;

a power cord extending through an end of said housing opposite said brush;

a rotary electrical connection within said tubular member connecting said power cord to said electrical wires;

a pair of circular disks secured at spaced locations along said tubular member;

a pair of undercut circular grooves formed in an interior wall of said housing;

said disks received for rotation in said undercut circular grooves;

a transversely extending well formed in said housing, between said undercut circular grooves;

a pinion gear disposed between said disks, within said housing, and secured for rotation with said tubular member;

a push button mounted for transverse reciprocal sliding movement within said well;

a gear rack on said push button in engagement with said pinion gear; and a coil spring in said well and having a first end abutting a lower end of said push button and a second end abutting a bottom surface of said well.

* * * * *